US006291772B1

(12) United States Patent
Easter et al.

(10) Patent No.: US 6,291,772 B1
(45) Date of Patent: Sep. 18, 2001

(54) HIGH PERFORMANCE POWER CABLE SHIELD

(75) Inventors: Mark R. Easter, Indianapolis; James Freestone, Avon, both of IN (US)

(73) Assignee: General Cable Technologies Corporation, Highland Heights, KY (US)

( * ) Notice: Subject to any disclaimer, the term of this patent is extended or adjusted under 35 U.S.C. 154(b) by 0 days.

(21) Appl. No.: 09/557,150

(22) Filed: Apr. 25, 2000

(51) Int. Cl.[7] ..... H01B 7/00; H01B 1/24

(52) U.S. Cl. ..... 174/102 SC; 252/511

(58) Field of Search ..... 252/511; 174/32, 174/35 MS, 102 SC

(56) References Cited

U.S. PATENT DOCUMENTS

| | | | |
|---|---|---|---|
| 3,849,333 | 11/1974 | Lloyd et al. | 252/511 |
| 4,305,846 | 12/1981 | Jennings | 252/470 |
| 4,612,139 | 9/1986 | Kawasaki et al. | 252/511 |
| 4,857,232 | 8/1989 | Burns, Jr. | 252/511 |
| 5,889,117 | 3/1999 | Flenniken | 525/222 |
| 6,013,202 | 1/2000 | Easter et al. | 252/511 |

*Primary Examiner*—Mark Kopec
(74) *Attorney, Agent, or Firm*—Blank Rome Comisky & McCauley LLP

(57) ABSTRACT

An improved shielding composition for power cables is disclosed. The composition includes a base polymer, conductive carbon black and various additives, including trimethylquinoline as an antioxidant in greater than conventional amounts. Cable shields prepared from the composition exhibit improved aging performance in accelerated cable life tests (ACLT).

14 Claims, No Drawings

HIGH PERFORMANCE POWER CABLE SHIELD

BACKGROUND OF THE INVENTION

1. Technical Field of the Invention

This invention relates to compositions of matter useful as shields in power cables and to shields and power cables utilizing the composition.

2. Description of the Related Art

Semiconductive shields have been used in power cables as shields for the cable conductor and insulation for many years. A conductor shield is typically extruded over the cable conductor to provide a layer of intermediate conductivity between the conductor and cable insulation in the power cable. A shield is also typically provided over the insulation. Conventional compositions for these shields include a base polymer as the predominant component of the composition compounded with, carbon black to provide conductivity for the composition and various additives including antioxidants, processing aids or lubricants and curing agents.

Examples of polymer compositions used as shields in power cables are found in the disclosures of U.S. Pat. Nos. 4,612,139 and 4,305,846 to Kawasaki et al., U.S. Pat. No. 4,857,232 to Burns, Jr., U.S. Pat. No. 3,849,333 to Lloyd et al., and U.S. Pat. No. 5,889,117 to Flenniken, the disclosures of which are hereby incorporated by reference.

As previously mentioned, one common additive to cable shield compositions is an antioxidant. Conventional antioxidants used in shielding compositions for power cables include stearically hindered phenols and amines such as polymerized 1,2-dihydro-2,2,4-trimethylquinoline, octadecyl, 3,5 diterbutyl-4-hydroxyhydrocinnamate, 4,4'-thio-bis-(3-methyl-6-tert-butylphenol), thiodithylene-'bis-(3,5-ditert-butyl-4-hydroxy) hydrocinnamate, distearyl-thiodispropionate, and mixtures of these compounds. The antioxidant components are generally included in the shield compositions in amounts significantly less than 1.0% by weight, typically less than 0.7%, by weight, of the shield compositions. The antioxidants function as stabilizers to prevent degradation of the polymer composition over time due to temperature.

SUMMARY OF THE INVENTION

The present invention is based upon the discovery that a particular antioxidant additive when incorporated in a conductor shield composition in particular amounts, significantly improves the performance of a cable shield composition. More specifically, the invention is based upon the discovery that the use of polymerized trimethylquinoline as the antioxidant additive for the conductor shield composition in amounts significantly higher than conventionally used in shield compositions, results in a cable shield exhibiting improved performance over cable shields formed with other antioxidant additives including trimethylquinolines. In particular, the composition of the invention exhibits superior performance over time as demonstrated by accelerated cable life testing (ACLT) as compared to shielding compositions which use conventional antioxidant additives in conventional amounts.

The invention, therefore, is a composition matter suitable for use in electric cables as a cable shield, comprising at least one base polymer, conductive carbon black in an amount which is sufficient to give the composition an electrical resistivity below 500 Ωm, and an antioxidant additive comprised of polymerized trimethylquinoline in an amount which is greater than 0.7% by weight of the composition, and preferably at least 1.0% by weight of the composition. Polymerized 1,2-dihydro-2,2,4-trimethylquinoline having a melting point of about 60° C. is most preferred as the antioxidant additive for use in the composition of this invention.

In addition to the composition matter, the invention includes a semiconductive shield for the conductor or insulation in a power cable formed by extruding the composition over the conductor or insulation of the power cable and the resulting power cable which employs the composition as a shield.

Further features of the invention will become evident to those of skill in the art upon reading the detailed description of the invention which follows.

DETAILED DESCRIPTION OF THE PREFERRED EMBODIMENT

The base polymer of the composition of the invention can be selected from a variety of polymers including copolymers of ethylene and a mono-unsaturated ester such as ethylene-ethyl acrylate, ethylene-methyl acrylate, ethylene-methyl methacrylate and ethylene-vinyl acetate, copolymers of ethylene and one or more alpha olefins having three to twelve carbon atoms, as well as EPR and EDPM rubbers, low density polyethylene (LDPE) and linear low density polyethylene (LLDPE). Of these copolymers, ethylene-vinyl acetate (EVA) is most preferred. More particularly, EVA having a vinyl acetate content between 18 and 20% is preferred for use as the base polymer in the composition in amounts ranging from 55–65% by weight of the composition and most preferably about 60% by weight of the composition.

The invention does not require any change or alteration to the current practice regarding the types and quantities of conductive carbon black used in the composition. Conventional types and proportions of conductive carbon black may be used. In particular, acetylene black, i.e. carbon black made by pyrolyzing acetylene, is used and incorporated into the composition in an amount which is sufficient to give the composition a resistivity no greater than 500 Ωm, and preferably a resistivity between 5 and 100 Ωm.

A tremendous number of compounds have been suggested for use as antioxidants in semiconducting shield compositions. Typically, these compounds fall into the category of stearically hindered phenols and amines. The present invention is based upon the discovery that one particular group of antioxidants, trimethylquinolines, when used in the composition at significantly higher than conventional amounts, i.e. greater than 0.7% by weight, and preferably at least 1.0% by weight of the composition, produce a shield composition having enhanced electrical aging performance as measured by accelerated cable life testing (ACLT). Trimethylquinolines having a melting point of about 60° C. and, in particular, polymerized 1,2-dihydro-2,2,4-trimethylquinolines having this melting point are especially preferred. A shield containing between 1.0 and 1.3% by weight this low molecular polymerized 1,2-dihydro-2,2,4-trimethylquinoline is most preferred for providing superior aging performance.

Additionally, processing aids and curatives may be added to the polymeric formulations for their known purposes. Although processing aids are not necessary to achieve homogeneous blends and reduced viscosity, they must be added into the composition of the present invention of further enhance these properties. For example, the processing aids may include, but are not limted to, metal stearates such as zinc stearate and aluminum stearate, stearate salts, stearic acid, polysiloxanes, stearamide, ethylene-bisoleyamide, ethylene-bisstearamide, mixtures thereof and the like. Processing aids, when incorporated into compositions of the present invention, are generally used in amounts of from about 0.1 to about 5.0 percent by weight, based on the total wright of the polymer composition. Curatives are typically organic peroxides incorporated into the composition in amounts generally up to 1.5% by weight.

The polymer compositions of the present invention may be manufactured using conventional machinery and methods to produce the final polymer product. The compositions may be prepared by bath or continuous mixing processes such as those well known in the art. For example, equipment such as Banbury mixers, Buss cokneaders, and twin screw extruders may be used to mix the ingredients of the formulation. The components of the polymer compositions of the present invention may be mixed and formed into pellets for future use in manufacturing such materials as insulated electrical conductors.

While the polymer compositions of the present invention may be incorporated into any product where the properties of the polymer composition are suitable, they are particularly useful for making insulated electrical conductors, such as electrical wires and power cables. More preferably, a semiconductive shield of the polymer composition may be formed directly over an inner electrical conductor as a conductor shield, or over an insulating material as a bonded or strippable insulation shield or as an outer jacketing material. The polymer compositions of the present invention may also be used in strandfilling applications in either conductive or nonconductive formulations.

To further illustrate the advantageous features of the invention, the following non-limiting examples are provided.

EXAMPLE 1

Accelerating Cable Life Test (ACLT)

Four power cables were prepared. The cables had a 1/0 19 wire stranded aluminum conductor surrounded by 15 mils. of the conductor shield (compositions specified in Table 1), surrounded by 175 mils. of cross-linked polyethylene insulation (Union Carbide 4201) surrounded by 35 mils. of semiconductive insulation shield (BICC General LS 567). A copper mesh was then wrapped around the insulation shield to provide the ground path for the shortout in the test. The conductor shield was extruded first and then the insulation and outer shield components were extruded over the conductor at one time on a Davis standard tandem extruder and dry cured under pressurized nitrogen in a continuous catenary vulcanization tube and water cooled.

Table I provides the composition of the conductor shield in each of the four tested cables.

TABLE I

CABLE SHIELDING COMPOSITIONS TESTED

| | Sample 1 | Sample 2 | Sample 3 | Sample 4 | Commercial Sample |
|---|---|---|---|---|---|
| EVA (18–20% VA) | 60.7 | 60.3 | 60.0 | 59.2 | Stated to contain EVA and acetylene black by manufacturer |

TABLE I-continued

CABLE SHIELDING COMPOSITIONS TESTED

| | Sample 1 | Sample 2 | Sample 3 | Sample 4 | Commercial Sample |
|---|---|---|---|---|---|
| Acetylene black | 38.0 | 38.0 | 38.0 | 38.0 | |
| TMQ* 120° C. melting point | 0.3 | | | | |
| TMQ* 60° C. melting point | | 0.7 | 1.0 | 1.3 | |
| Dicamyl peroxide | 1.0 | 1.0 | 1.0 | 1.5 | |

*polymerized 1,2-dihydro-2,2,4-trimethylquinoline

A commercially available power cable stated to contained ethylene-vinyl acetate and acetylene black by the manufacturer was also tested.

The four test cable specimens and commercial cable were subjected to accelerated cable life testing (ACLT) using the following protocol:

Five samples of 15 kv-rated cable were prepared for the test. Samples were preconditioned for 72 hours at 90° conductor temperature in free air. The center of each sample was immersed in 50° water. The cable conductor temperature in the water was controlled to 75° for 8 hours each 24 hour period. For the remaining 16 hours, the heating current was turned off. The samples were energized at four times normal voltage stress (34.6 kv) until all test samples failed.

The failure times were analyzed using extreme value distribution statistics (Weibull) to assess comparative mean life equivalency or enhancements versus control(s). For the Weibull distribution, the distribution parameters are ETA ($\alpha$), the scale parameter and data ($\beta$), the shape parameter. The scale parameter measures the relative scope or largeness of the variable in question (life in days) while the shape parameters measures the variation (or range min. to max.) in the individual data (failure times) results of the population is sample. Both parameters of the test population best fit distribution were compared to a controlled population. Results of the ACLT testing are contained in Table II.

TABLE II

ACCELERATED CABLE LIFE TEST (ACLT)

| | Sample 1 | Sample 2 | Sample 3 | Sample 4 | Commercial Sample |
|---|---|---|---|---|---|
| Test results in days to failure | 5.6, 5.9, 6.0, 6.4, 7.4 | 11.3, 26.6, 48.3, 57.0 | 34, 44, 78, 172, 232 | 100 days no failures | 27, 30, 33, 34, 51 |
| Weibull Life,days | 6.23 | 34.6 | 125 | N/A | 37.5 |

EXAMPLE 2

Elongation retention and tensile strength retention were determined for the compositions used in cable specimens and commercial sample according to ASTM D412.

TABLE III

| ORIGINAL TENSILE AND ELONGATION | | |
|---|---|---|
| | % Elongation | Tensile psi |
| Sample 1 | 284 | 3280 |
| Sample 2 | 230 | 2830 |
| Sample 3 | 297 | 2769 |
| Sample 4 | 312 | 2698 |
| Commercial Sample | 326 | 2470 |

TABLE IV

| HEAT AGING 7 DAYS AT 120° C. ASTM | | |
|---|---|---|
| | % Elongation | Tensile psi |
| Sample 1 | 96 | 114 |
| Sample 2 | 106 | 107 |
| Sample 3 | 100 | 105 |
| Sample 4 | 102 | 101 |
| Commercial Sample | 93 | 108 |

TABLE V

| HEAT AGING 7 DAYS AT 150° C. ASTM | | |
|---|---|---|
| | % Elongation | Tensile psi |
| Sample 1 | 79 | 88 |
| Sample 2 | 77 | 95 |
| Sample 3 | 78 | 98 |
| Sample 4 | 71 | 103 |
| Commercial Sample | 85 | 96 |

Table IV contains the original tensile strength and elongation measurements while Tables V and VI include the percent elongation and tensile strength retained after heat aging for several days at 120° C. and 150° C.

From the data contained in Tables I–V of the examples, it is seen that cable test samples 3 and 4 which included as the antioxidant additive trimethylquinoline in accordance with the invention exhibit superior results in the ACLT test compared to cables made with other antioxidant components or lower amounts of TMQ. On the other hand, the tensile strength and elongation properties of the cable samples show that increasing the amount of antioxidant in the composition does not enhance the original or aged tensile and elongation properties and, indeed, often results in a decrease in the tensile strength and elongation properties. It is, therefore, surprising and unexpected that the increase in amount of antioxidant significantly above conventional amounts for shielding compositions results in enhanced electrical aging performance for the composition.

While the present invention has been described in terms of certain preferred embodiments, these embodiments are intended to illustrate and not limit the scope of the invention, It will, therefore, be apparent to those of ordinary skill in the art that various modifications can be made to the invention without departing from the spirit and scope therefore. It is, therefore, the intent of the inventors to limit the invention solely by the appended claims.

We claim:

1. A composition of matter suitable for use in electrical cables, comprising at least one base polymer, conducive carbon black in an amount to give the composition electrical resistivity below 500 Ωm and an antioxidant additive comprised of polymerized trimethylquinoline in an amount which is greater than 0.7% by weight of the composition.

2. The composition of claim 1, wherein said polymerized trimethylquinoline has a melting point of about 60°.

3. The composition of claim 1, wherein said polymerized trimethylquinoline is polymerized 1,2-dihydro-2,2,4-trimethylquinoline.

4. The composition of claim 1, wherein said polymerized trimethylquinoline is present in an amount of at least 1.0% by weight of the composition.

5. The composition of claim 1, wherein said at least one base polymer is a polymer selected from the group consisting of copolymers of ethylene and a mono-unsaturated ester, copolymers of ethylene and one or more alpha olefins having three to twelve carbon atoms, EPR and EDPM rubbers, low density polyethylene and linear low density polyethylene.

6. The composition of claim 5, wherein said polymer is a copolymer of ethylene and vinyl acetate.

7. The composition of claim 6, wherein said copolymer has a vinyl acetate content between 18% and 20%.

8. The composition of claim 7, wherein said copolymer is present in an amount of about 55–65%, by weight, of the composition.

9. The composition of claim 8, wherein said carbon black is present in an amount of about 35% to 45%, by weight, of the composition.

10. An electric power able having at least one conductor, a conductor shield surrounding said at least one conductor, insulation surrounding said conductor shield, a dielectric shield surround said insulation and a protective layer surrounding said dielectric shield, said conductor shield comprising at least one base polymer, conductive carbon black in an amount to give the composition an electrical resistivity below 500 Ωm and an antioxidant additive comprised of polymerized trimethylquinoline in an amount which is greater than 0.7% by weight, of the conductor shield.

11. The power cable of claim 10, wherein said polymerized trimethylquinoline has a melting point of about 60°C.

12. The composition of claim 10, wherein said polymerized trimethylquinoliline is polymerized 1,2-dihydro-2,2,4-trimethylquinoline.

13. The power cable of claim 10, wherein said polymerized trimethylquinoliline is present in said conductor shield in an amount between 10.% and 1.3% by weight.

14. The power cable as claimed in claim 10, wherein said polymer is a copolymer of ethylene and vinyl acetate, having a vinyl acetate content between about 18% and 20% by weight.

* * * * *